United States Patent [19]

Van Doorn et al.

[11] 4,407,047

[45] Oct. 4, 1983

[54] COTTON GINNING SYSTEM EMBODYING A LINT CLEANER AND PROCESS OF OPERATING THE SAME

[75] Inventors: Donald W. Van Doorn; Tommy W. Webb; James B. Hawkins, all of Columbus, Ga.

[73] Assignee: Lummus Industries, Inc., Columbus, Ga.

[21] Appl. No.: 208,159

[22] Filed: Nov. 19, 1980

[51] Int. Cl.[3] ..... D01B 1/06; D01H 5/32

[52] U.S. Cl. ..... 19/64.5; 19/202; 19/204; 19/240

[58] Field of Search ..... 19/0.23, 54, 55 R, 202, 19/64.5, 240, 204, 205

[56] References Cited

U.S. PATENT DOCUMENTS

| | | | |
|---|---|---|---|
| 3,032,830 | 5/1962 | Van Doorn et al. | 19/202 |
| 3,108,332 | 10/1963 | Moss et al. | 19/202 |
| 3,177,529 | 4/1965 | Neitzel et al. | 19/64.5 |
| 3,264,689 | 8/1966 | Neitzel et al. | 19/64.5 |
| 3,495,303 | 2/1970 | Slover | 19/55 R |
| 3,984,896 | 10/1976 | Hicks | 19/0.23 |
| 4,126,913 | 11/1978 | Roberson | 19/204 X |
| 4,253,215 | 3/1981 | Mangialardi | 19/202 |

OTHER PUBLICATIONS

Lummus Cotton Ginning Machinery; Bulletin No. 912, Lummus Cotton Gin Co., Columbus, GA.

"Performance Evaluation on High Capacity Lint Cleaners" by Roy V. Baker, Publ. in Ginners' Journal and Yearbook, 1977.

"Performance Characteristics of Saw Type Lint Cleaners" by Roy V. Baker, Transactions of the ASEA, vol. 21, No. 6, pp. 1081–1087 & 1091.

"Improving Gin-Lint Cleaning for the Removal of Open-End Spinning Micro Dust" by Jack D. Towery & Roy V. Baker, Textile Research Journal, vol. 49, No. 3, Mar. 1979.

*Primary Examiner*—Louis Rimrodt

*Attorney, Agent, or Firm*—Woodford R. Thompson, Jr.

[57] ABSTRACT

A cotton ginning system embodying a lint cleaner and a process of operating the same in which the batt of cotton delivered to the lint cleaner is maintained at an optimum thickness even though the rate of ginning varies. The batt thickness is maintained by correlating the same with the rate of feed of seed cotton to the system. Controls are provided to assure that the batt remains at optimum thickness, and such optimum thickness is assured by sensing the rate of input of seed cotton to the system.

7 Claims, 5 Drawing Figures

COTTON GINNING SYSTEM EMBODYING A LINT CLEANER AND PROCESS OF OPERATING THE SAME

This invention relates to a cotton ginning system embodying lint cleaners and a process for operating the same to obtain an improvement in cleaning efficiency and simultaneously a reduction in fiber loss.

Basically all saw type lint cleaners, when properly adjusted, have an optimum batt thickness for maximum cleaning efficiency with minimum fiber damage and minimum fiber loss, for every ginning rate. Various persons and organizations, including these applicants and the United States Department of Agriculture Ginning Laboratory at Lubbock, Texas, have conducted experiments and documented information concerning the batt thickness, fiber damage and lint loss at various ginning rates. For instance, see the following literature: (1) "PERFORMANCE EVALUATION ON HIGH CAPACITY LINT CLEANERS" by Roy V. Baker, published in "Ginners' Journal and Yearbook", 1977; (2) "PERFORMANCE CHARACTERISTICS OF SAW TYPE LINT CLEANERS" by Roy V. Baker, Transactions Of The ASEA, Volume 21, No. 6, pages 1081 to 1087, inclusive, and page 1091; (3) "IMPROVING GIN-LINT CLEANING FOR THE REMOVAL OF OPEN-END SPINNING MICRODUST" by Jack D. Towery and Roy V. Baker, "Textile Research Journal", Volume 49, No. 3, March, 1979.

A review of the foregoing articles confirms the need to change the combing ratio (the speed of the feed works of the saw type lint cleaner) when the rate of feed of the lint cotton to the lint cleaner varies. Specifically and stated differently, these studies confirm the need to change the speed (rpm) of the lint cleaner feed works when the feed of cotton thereto in pounds per hour or other units varies.

In present gin lint cleaner installations the batt thickness varies as the rate of ginning varies because the feed works of the present lint cleaners are driven from fixed speed saw shafts. Some lint cleaners are provided with means to change from one speed ratio to another but these means are step sheaves, etc., which cannot be changed quickly as ginning rate varies. Furthermore, manually changed step sheaves are ineffective, overall, because few operators understand what batt thickness is required to effect the optimum cleaning with minimum fiber loss and damage. Where step sheaves are provided the operators as often as not will set the belts in the wrong sheave groove, thus worsening the condition which they have attempted to correct. Furthermore, the rate of ginning varies constantly, from one moment to the next; consequently, any attempt to make the necessary changes in the speed of the feed works, through purely mechanical means, in effect is impossible to do.

The basic reasons why it is important to maintain a batt of the proper thickness are as follows: (1) If the batt operated upon by the saws of the lint cleaner is too thin, the feed roller and feed plate of the lint cleaner cannot properly grip the batt and the saw teeth will pull large tufts from the batt, resulting in improper combing and trash removal as well as the loss of good lint due to being thrown off at the grid bars. (2) If the batt is too thick, the saw teeth must plow through too heavy a mass of fibers and fiber damage results, cleaning efficiency is lessened and fiber loss increases. See FIG. 4 of the above referenced report "PERFORMANCE CHARACTERISTICS OF SAW-TYPE LINT CLEANERS".

In view of all of the foregoing it is a prime object of our invention to provide a feed works modulation system and process of operating the same which shall assure that the batt delivered to the feed works of the lint cleaner is of optimum thickness at all times during the ginning process, regardless of variations in the ginning rate, or other factors affecting the delivery of such batt.

A more specific object of our invention is to provide an apparatus and process of the character designated in which the batt delivered to the lint cleaner is maintained at optimum thickness as a function of the rate of feed of seed cotton to the system.

Still more specifically, an object is to deliver a batt of optimum thickness, at all times, to the lint cleaner, which thickness is in proportion to the rate of rotation of the feed rolls of the seed cotton feeder.

More specific and additional objects are to incorporate means such as limit switches or the like in the hopper or hoppers above the feeder or feeders to assure that the feed rolls of the feeder are being fully supplied with cotton. To further enhance the accuracy of control over the batt thickness we provide a time delay effective to compensate for the time that it takes the seed cotton to pass through the feeder and the gin stand and thence through the duct system to the lint cleaner where it is formed into a batt by the lint cleaner condenser, thus further assuring the synchronized delivery of a batt of optimum thickness to the feed works of the lint cleaner.

Apparatus illustrating the constructional features of our invention and which also may be used to carry out our improved process is shown in the accompanying drawings forming a part of this application in which.

Figure 1:
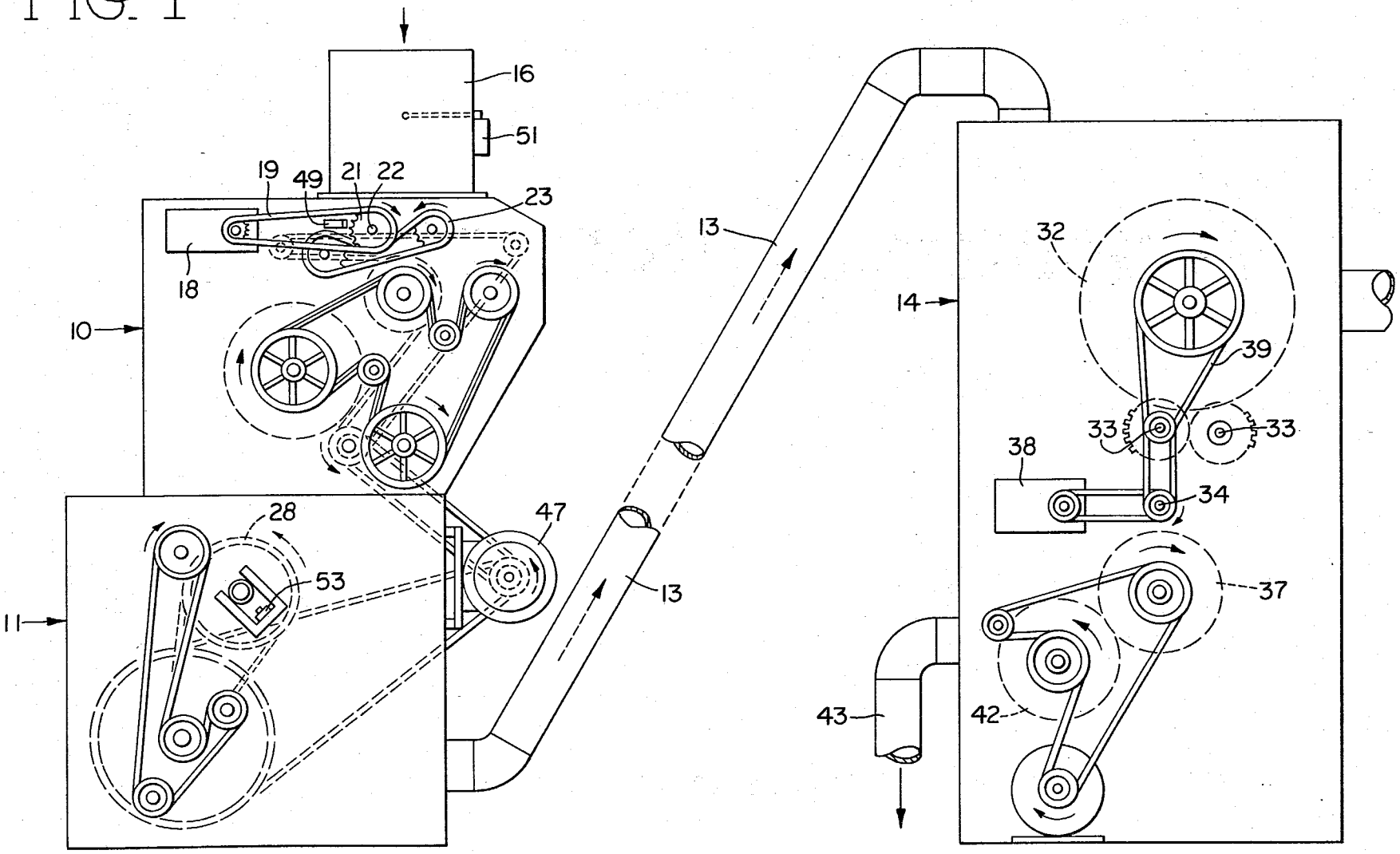
FIG. 1 is a somewhat diagrammatic side elevational view of a cotton ginning system embodying a seed cotton feeder, a gin, and a lint cleaner, certain of the parts being broken away and in section.
Figure 2:
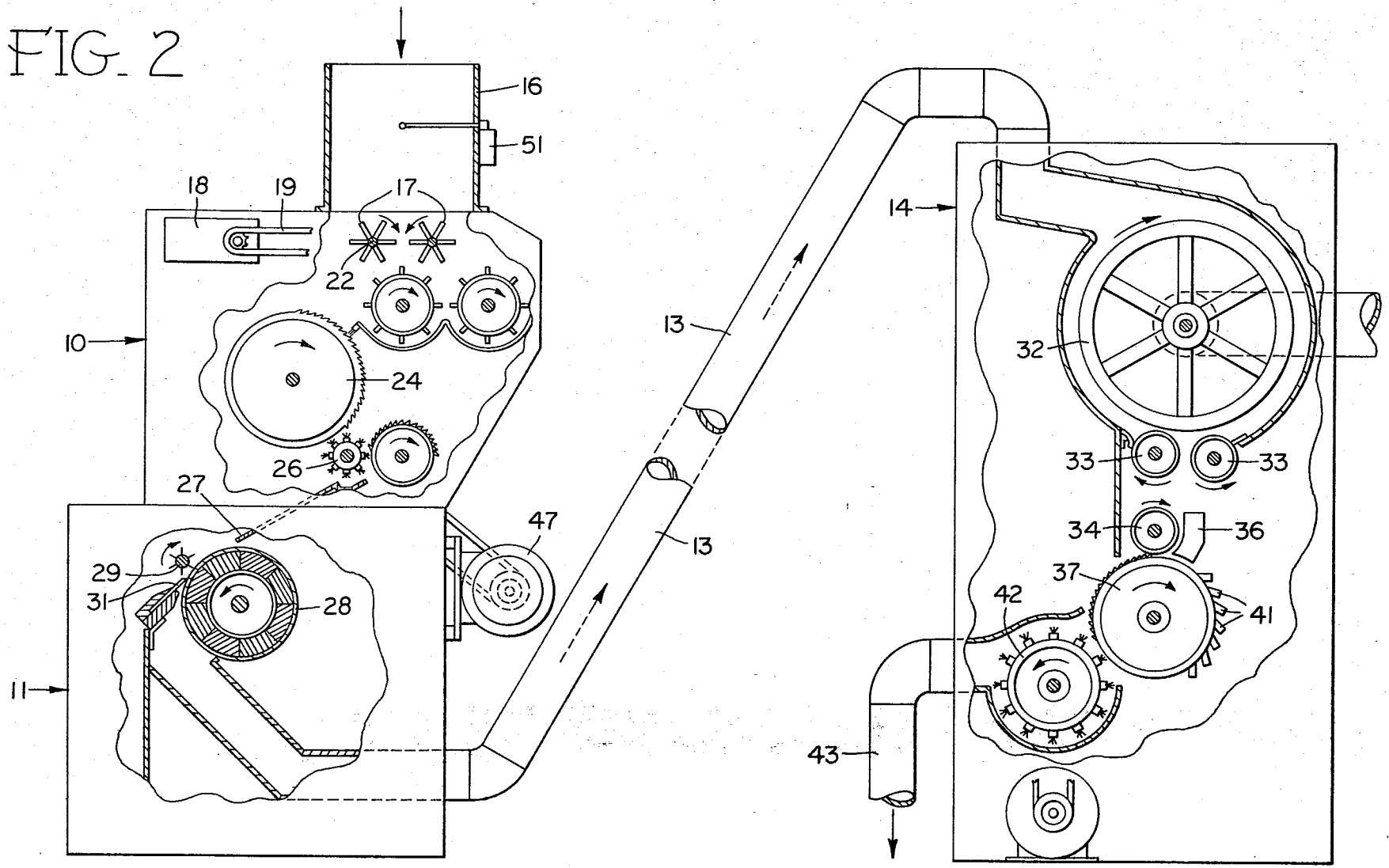
FIG. 2 is a view corresponding generally to FIG. 1 with certain of the parts broken away and in section.

Referring now to the drawings for a better understanding of our invention and particularly to FIGS. 1 and 2, we show our invention incorporated into a ginning and lint cleaning system. Thus, at 10 we indicate generally a feeder which is located over a gin stand indicated at 11. While in the drawings we show a roller gin, it will be apparent as the description proceeds that a saw type gin may be used in place of the same. Thus, and as is well known, seed cotton proceeds from the feeder 10 to the gin 11 and lint through a lint flue or duct 13 to the lint cleaner indicated generally by the numeral 14.

As is further understood in the art, the feeder 10 may embody a feed hopper 16. Seed cotton from other machinery is fed into the hopper 16 which, in normal ginning operation, is maintained full of cotton, across its full length.

At 17 we show the usual pair of feed rollers for the feeder. These feed rollers are driven from a variable speed drive 18 through a suitable flexible member such as a chain 19, the chain passing over a sprocket 21 fast on the end of a shaft 22 on one of the feed rollers 17. The other feed roller 17 is driven in the direction of the arrows, FIG. 2, by means of a flexible drive illustrated in FIG. 1 and which may embody a chain 23. Thus, and as will later appear, the feed rollers 17 are driven in unison and at the same speed, in the direction of the arrows, FIG. 2, through the variable speed drive 18.

Also as is understood, seed cotton is fed by the rollers 17 onto a saw cylinder 24 from which it is doffed by the brush doffer 26. Seed cotton then falls down a slide 27 into the ginning works of the gin which as shown may be roll 28, rotary knife 29, and stationary knife 31. Lint from the seed is carried through the duct 13 where it is deposited onto the drum 32 of a condenser forming a part of the feed works of the lint cleaner 14. The lint cotton forms as a batt on the surface of the condenser 32. Associated with the condenser 32 is a pair of doffing rollers 33. Located beneath the doffing rollers 33 in position to receive the batt from the same is a feed roller 34 which cooperates with a feed plate 36 to feed the batt of cotton to the saw cylinder 37 of the lint cleaner. From FIG. 1 it will be seen that the rollers 33 and 34 are driven by a variable speed drive 38. Also, the condenser 32 is driven as shown in FIG. 1 from said drive 38 through a drive such as a chain or the like 39.

The batt of cotton, emerging from between the roller 34 and the plate 36, is engaged by the saw cylinder 37 and the cotton is carried around in the direction of the arrow. Due to centrifugal force the lint is whipped across the bars 41, resulting in the desired cleaning action. Doffing from the cylinder 37 is by means of a brush doffer 42, the lint then going from the lint cleaner 14 through a conduit 43 to subsequent processes, such as baling.

From what has just been described it will be seen that the condenser cylinder 32, and the rollers 33 and 34 together with the feed plate 36, constitute the feed works of the lint cleaner. While in practice there may be other or intermediate rollers in these feed works, we have chosen in this instance to illustrate only those rollers which are required to accomplish the function desired, namely, to remove the batt from the cylinder 32 and to feed it onto the saw cylinder 37.

From the description so far given it will be seen that our invention contemplates controlling the rate of speed of the feed works of the lint cleaner in accordance with the rate of rotation of the feed rollers 17 of the feeder 16, thereby to assure the feeding to the saw cylinder 37 of a batt of optimum thickness.

Figure 4:
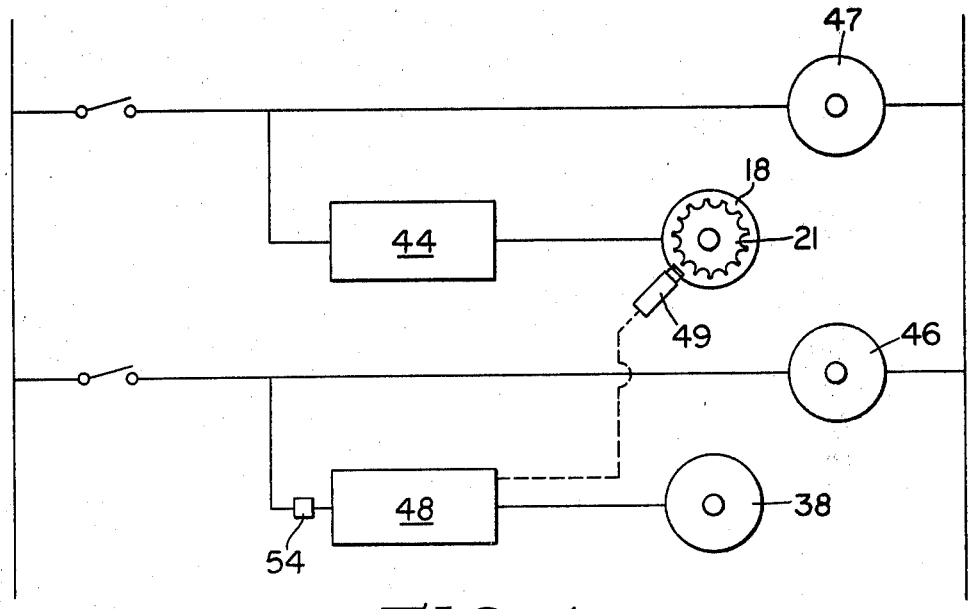
FIG. 4 is a wholly diagrammatic wiring diagram for the variable speed motors or drives which drive the feed rolls of the feeder and the feed rolls of the lint cleaner.
Figure 3:
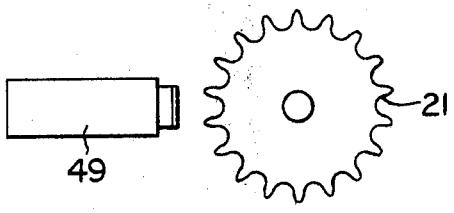
FIG. 3 is a detail view illustrating the association of a sensor with one of the sprockets which drive the feed rolls of the feeder.

Referring now to FIG. 4 of the drawings, we illustrate in diagrammatic fashion a controller 44 which is effective to vary the speed of the motor 18, thus to vary the rate of feed of seed cotton into the system. The controller 44 may get its signal from various sources. Thus, and by way of example, if the gin stand 11 is of the saw type controller 44 could get its signal from the apparatus shown and described in U.S. Pat. No. 3,032,830. The speed of the variable drive 18 may be automatically varied, through the controller 44, to maintain the ginning rate at an optimum rate, for varying conditions of the cotton being operated upon. Also, the controller 44 may emit signals in response to the current draw of drive 47 which drives the feeder and gin. As is known, the current draw of the drive 47 is indicative not only of the rate of ginning, but also of the condition of the cotton being ginned. Therefore, and in summary, it can be said that the controller 44 is capable of controlling the speed of the variable drive 18 in response to various conditions of the cotton and conditions of ginning found in the system, all as are well known in the art.

Figure 5:
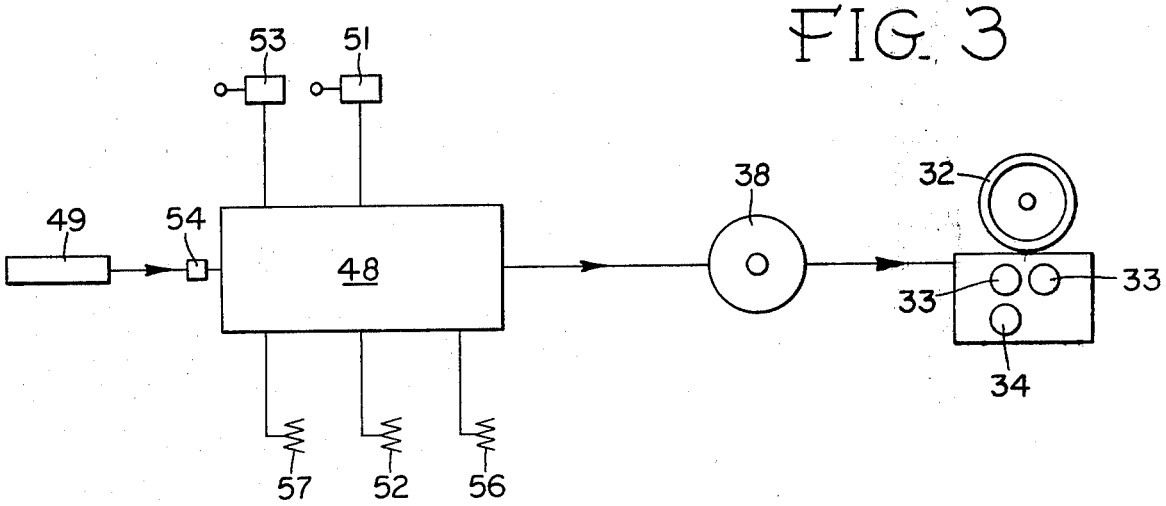
FIG. 5 is a wholly diagrammatic view illustrating the controller for controlling the rate of speed of the feed rollers of the lint cleaner.

In FIG. 5 we show more in detail, still in diagrammatic form, a controller 48 for controlling the speed of the lint cleaner feed works through the variable speed motor or drive 38. The controller 48 is responsive to a signal produced by a sensor 49 physically located close to the sprocket 21. In other words, the sensor 49 feeds to controller 48 a signal which is representative of the speed of rotation of the sprocket 21 and hence is indicative of the speed of rotation of the feed rollers 17 themselves.

Also associated with the controller 48 is a switch 51. Switch 51 is located in the feed hopper 16 of the feeder 10 and is closed when there is cotton present in the hopper 16 and opened when there is no cotton in the same. Therefore, through switch 51 controller 48 may be caused either to hold the speed of the drive 38 at the rate corresponding to the last signal received by it or, may cause the drive 38 to go into a predetermined low minimum speed as determined by a manual control 52.

A switch 53 is positioned on the gin stand in such position relative to the movable portions thereof, either of the roll 28 or the gin breast if the same be a saw type gin, to give a signal to the controller 48. Whenever the gin is in inoperative or non-ginning position, the signal received by the controller 48 from switch 63 causes the motor 38 to slow to the predetermined minimum speed as determined by the adjustment 52. In view of the fact that it takes several seconds for cotton being fed in at 17 to reach the feed works of the lint cleaner, we provide as diagrammatically shown at 54 a time delay device. The time delay 54 is manually set, imperically, to delay the receipt by the controller 48 of the signals from the sensor 49 in order to compensate for the in-transit time of the cotton between the feed rollers 17 and the feed works of the lint cleaner.

As shown in the publication "PERFORMANCE EVALUATION ON HIGH CAPACITY LINT CLEANERS", above referred to, it is known that there is a maximum speed of operation of the feed works of the lint cleaner beyond which no further gains can be made. In view of this at 56 we provide a manually adjustable control which limits the maximum speed that motor 38 can impart to the lint cleaner feed works. Therefore, the speed of the feed works operates between the maximum as determined by the control 56 and the minimum as determined by the control 52.

Diagrammatically shown at 57 is bias circuitry for the controller 48 the purpose of which is to control the degree of output response of the control 48 to the input signal received from the sensor 49.

The output signals from the controller 48 may be either a linear or non-linear function of the input signal.

From the foregoing it will be apparent that we have devised an improved apparatus and process which results in increasing the efficiency of cotton lint cleaners. With the system in operation the sensor 49 delivers a signal to the controller 48 which is representative of the rate of feed of seed cotton to the gin and hence representative of the rate of delivery of lint cotton to the lint cleaner. The amount of cotton delivered to the gin is controlled by the controller 44 which itself may receive signals from the various places, and perhaps others, mentioned above. The modified or modulated signal from the controller 48 is then sent to the feed works of the lint cleaner as stated, thereby delivering to the saws of the lint cleaner, during all phases of ginning, a batt of optimum thickness.

As an additional safety both for the lint fibers themselves and the operating personnel, when the gin breast or roll is moved to non-ginning position switch 53, through controller 48, automatically causes the speed of the feed works of the lint cleaner to drop to the preset minimum as determined by the set means diagrammatically indicated at 52. Thus, when the gin is moved to non-ginning position any tags that might break loose are fed out of the system and the operators will not be lured into thinking that the feed works is turned off, avoiding injury to the operators in the event the gin commences to gin cotton again.

Our invention is particularly useful for its intended purposes because ginning rates can vary over a ratio of as much as four to one or five to one. The combing ratio, of course, varies inversely as the speed of the feed works varies. It will be recalled, as shown in FIG. 2 of the attached report entitled "PERFORMANCE EVALUATION OF HIGH CAPACITY LINT CLEANERS", that the cleaning efficiency of any lint cleaner increases inversely to the rate of cotton flow through the lint cleaner. However, to obtain the maximum cleaning efficiency and minimum lint loss as the ginning rate varies, the lint cleaner combing ratio must vary also. With our invention as herein disclosed even though the rate of ginning varies widely, the operator can be confident that at the rates of ginning his lint cleaners are accomplishing the maximum cleaning efficiency possible. Thus, the operator does not have to fear that his batt will get too thick, resulting in fiber damage, lint loss and lowered cleaning efficiency when he is ginning at higher rates; similarly, he does not have to fear that he will lose valuable lint and suffer grade loss when he is forced to cut back his ginning rate to meet conditions of rough or wet cotton, etc.

While we have shown our invention in but one form, it will be obvious to those skilled in the art that it is not so limited, but is susceptible of various changes and modifications without departing from the spirit thereof.

What we claim is:

1. In a process of operating a cotton ginning system which includes a seed cotton feeder having driven feed means for delivering seed cotton to a gin and a lint cotton cleaner having a driven feed works for delivering the lint received from the gin to a driven worker such as a saw, the steps of:

(a) continuously sensing the rate of motion of the feeder feed means and from said sensing thereof obtaining signals representative of the amount of seed cotton being delivered by the feeder to the gin, and (b) utilizing said signals while the system is in operation to vary the rate of motion of the lint cleaner feed works to deliver predetermined desired batt thickness of lint cotton from the lint cleaner feed works to the saw.

2. The process of claim 1 in which the driven feed means of the feeder and the cleaner feed works comprise rotary members, said signals being obtained by sensing the rate of rotation of the rotary members of the feeder feed means.

3. The process of claim 1 in which the lint cotton cleaner is of the saw type, and in which the feed works for the lint cleaner comprises a rotary condenser member on which lint from the gin collects in batt form, together with a plurality of doffing and feed rollers driven in timed relation to the condenser member, said signals being used to vary the rate of rotation of said rotary member and said doffing and feed rollers in accordance with the amount of seed cotton being delivered to the gin, thereby to maintain the batt of cotton delivered to the saws of the cleaner at substantially the same thickness during ginning.

4. The process of claim 1 including the further step of modifying the effect of said signals on the rate of motion of the lint cleaner feed works to limit the rate of motion of the lint cleaner feed works to a predetermined maximum and minimum rate.

5. The process of claim 4 including the further step of automatically stopping said signals when the flow of seed cotton to the feeder feed works reaches a predetermined minimum.

6. The process of claim 1 including the further step of delaying the effect of said signals on the rate of motion of the feed works of the cleaner, whereby to compensate for the in-transit time from feeder to lint cleaner feed works.

7. The process of claim 1 including the further step of automatically stopping the gin upon a cessation of flow of cotton thereto from the feeder and the further step of reducing the rate of motion of the lint cleaner feed works to a predetermined minimum.

* * * * *